US008684429B1

(12) United States Patent
Holub

(10) Patent No.: US 8,684,429 B1
(45) Date of Patent: Apr. 1, 2014

(54) DEBRIS COLLECTION AND DISPOSAL TOOL

(71) Applicant: Elvin Gene Holub, Enid, OK (US)

(72) Inventor: Elvin Gene Holub, Enid, OK (US)

( * ) Notice: Subject to any disclaimer, the term of this patent is extended or adjusted under 35 U.S.C. 154(b) by 0 days.

(21) Appl. No.: 13/986,300

(22) Filed: Apr. 19, 2013

Related U.S. Application Data

(60) Provisional application No. 61/687,578, filed on Apr. 27, 2012.

(51) Int. Cl.
*A01K 29/00* (2006.01)

(52) U.S. Cl.
USPC ..... 294/1.4

(58) Field of Classification Search
CPC ..... E01H 1/006; E01H 1/12; E01H 1/1206; E01H 2001/12; E01H 2001/1246; A01K 23/005; B65B 67/1238; B65B 67/12; B65B 67/1205; B65B 67/1211; B65F 2240/138; A47L 13/52
USPC ..... 294/1.5, 1.3, 214, 1.4; 15/257.1, 257.3, 15/257.4, 257.6, 257.8, 257.9; 248/99, 248/100, 101
See application file for complete search history.

(56) References Cited

U.S. PATENT DOCUMENTS

| | | | | |
|---|---|---|---|---|
| 3,659,891 | A | 5/1972 | Pettenon | |
| 3,819,220 | A | 6/1974 | Bredt | |
| 4,191,414 | A | 3/1980 | Dameron | |
| 4,723,803 | A * | 2/1988 | Sapp | 294/214 |
| 4,786,095 | A | 11/1988 | Dumont | |
| 5,031,948 | A * | 7/1991 | Groth et al. | 294/214 |
| 5,634,678 | A | 6/1997 | Bailey | |
| 5,868,447 | A | 2/1999 | Clark | |
| 7,618,073 | B2 * | 11/2009 | Casper | 294/1.4 |
| 7,665,489 | B1 * | 2/2010 | Smith | 141/108 |
| 7,845,695 | B2 | 12/2010 | Eyton | |
| 8,038,190 | B2 * | 10/2011 | Zidulka et al. | 294/1.5 |
| 8,066,311 | B2 | 11/2011 | Axelrod | |
| 8,109,547 | B1 | 2/2012 | Miller | |
| 8,511,728 | B2 * | 8/2013 | Beaton | 294/1.4 |
| 2003/0085581 | A1 * | 5/2003 | Jemison | 294/1.4 |
| 2004/0221872 | A1 * | 11/2004 | Perelli et al. | 134/6 |
| 2004/0256869 | A1 * | 12/2004 | Avishay | 294/1.4 |
| 2011/0037280 | A1 * | 2/2011 | Romero | 294/1.4 |
| 2012/0104780 | A1 * | 5/2012 | Lloyd et al. | 294/1.3 |
| 2013/0249224 | A1 * | 9/2013 | Ng | 294/1.4 |
| 2013/0343677 | A1 * | 12/2013 | Faraone | 383/33 |

* cited by examiner

*Primary Examiner* — Saul Rodriguez
*Assistant Examiner* — Gabriela Puig
(74) *Attorney, Agent, or Firm* — Randal D. Homburg

(57) ABSTRACT

A portable waste disposal tool uses recycled plastic merchandise bags secured to a frame by an adjustable tensioning bag clamp and sliding lock assembly, including a sliding lock and a bag clamp, the frame holding the bag in an open position to contain debris from an indoor or outdoor hard surface, a yard or other ground surface, including dirt, dust, yard waste and pet waste. The frame is attached to the lower end of an elongated extension handle wherein the waste is maintained within the plastic bag until deposited in a trash receptacle by a simple single handed release of the bag clamp.

8 Claims, 5 Drawing Sheets

DEBRIS COLLECTION AND DISPOSAL TOOL

CROSS REFERENCE TO RELATED APPLICATIONS

Applicant claims the benefit of Provisional Patent Application No. 61/687,578, filed on Apr. 27, 2012 by the same inventor.

BACKGROUND OF THE INVENTION

1. Field of Invention

A portable waste disposal tool uses recycled plastic merchandise bags secured to a frame by an adjustable tensioning bag clamp and sliding lock assembly, including a sliding lock and a bag clamp, the frame holding the bag in an open position to contain debris from an indoor or outdoor hard surface, a yard or other ground surface, including dirt, dust, yard waste and pet waste. The frame is attached to the lower end of an elongated extension handle wherein the waste is maintained within the plastic bag until deposited in a trash receptacle by a simple single handed release of the bag clamp.

2. Description of Prior Art

A preliminary review of prior art patents was conducted by the applicant which reveal prior art patents in a similar field or having similar use. However, the prior art inventions do not disclose the same or similar elements as the present debris disposal and collection tool, nor do they present the material components in a manner contemplated or anticipated in the prior art.

Several prior art devices disclose scooping tools that employ the use of an attached bag. In U.S. Pat. No. 8,109,547 to Miller, a device is provided with a handle attached to a wire frame, the wire frame provides an anchor for one side of a bag and a slide bar, slidably mounted upon the wire frame, anchors the other side of the opening of the bag, with a sliding member on the handle forcing the slide bar back and forth along the wire frame to open and close the attached bag. A tool with a ring opening attaches a bag by use of an annular ring, as disclosed in U.S. Pat. No. 5,634,678 to Bailey, with the annular ring either a separate component of the bag or part of the opening of the bag. A fixed scoop having a rear opening with a bag attached to the rear opening by a hook, knobs or having the bag tied to the scoop member providing no tension adjustment or quick single handed release means to the bag is indicated in U.S. Pat. No. 5,868,447 to Clark. A similar product is shown in U.S. Pat. No. 3,659,891 to Pettenon, except the bag is apparently proprietary and the front opening is custom fitted over the front edge of the fixed scoop, the bag providing its own tension to secure it to the fixed scoop.

A simple triangular wire frame is shown in U.S. Pat. No. 4,191,414 to Dameron, wherein a bag is fitted around the triangular wire frame with a portion being stretched over at least on bight, the bag held open to receive contents. In U.S. Pat. No. 3,819,220 to Bredt, a device discloses a hollow handle with a grip on one end and an opening in the other end, having a retractable tool end which includes a pair of resilient arms which spread into an open V-shape when extended outside the handle opening and compress together when retracted inside with a bag having two slide channels built into the bag, each slide channel receiving on the two resilient arms, wherein the bag is opening when the resilient arms are fully extended, and the bag is closed and perhaps even drawn within the handle opening when the resilient arms are fully retracted within the handle.

A simple tool is disclosed in U.S. Pat. No. 7,618,073 to Casper, which defines a handle with a fixed frame on a tool end and a handle on the grip end, an upper clip and a lower clip above and below the fixed frame on the handle at the tool end, the upper and lower clips attaching opposing sides of an upper opening of the bag. This device provides no adjustable tension to the bag and also does not provide for a simple release of the bag from the frame without some form of intervention, unlike the present invention.

SUMMARY OF THE INVENTION

Routine cleaning tasks often require the use of some type of tool to contain debris. When sweeping, a dust pan is used to contain the debris swept up by a broom. A bag or other container is used to pick up lawn debris, including pet waste, until it can be deposited into a receptacle or another preferred location. Several devices, as discovered in a search of the present waste disposal tool, provide some type of elongated handle with a device at the lower end which has the capability of maintaining waste within a structure or an attached bag. Some use an elastic band to hold the bag to a frame while others use different types of attaching means. Most of the prior art devices are distinguished from the present tool by the required use of two hands to remove their bags, while others are distinguished by requiring use of proprietary bags which require renewed purchase of new bags during the duration of the devices.

The objective of the present tool is to use a recycled plastic bag or other appropriate sized bags that are generally used for groceries or other merchandise and would otherwise be thrown away. Devices using proprietary bags can become expensive over time, and other devices with an incorporated receiver can become soiled, which is often the case when removing pet waste. By using the recycled bags, one simply disposes of the bag as they would have in the first place, except now with the removed waste contents. There is no cleanup and there is no required "touching" of the waste or the bag containing the waste by the user. It is also an objective to provide the manner of securing the recycled bag to the frame with the adjustability of the clamp to allow more than one size of plastic bag to be used and still secure to the frame without being casually disengaged. It is also an objective that the release of the filled bag be accomplished with a simple one-handed release.

DESCRIPTION OF THE DRAWINGS

The following drawings are informal drawings submitted with this utility patent application.

DESCRIPTION OF THE PREFERRED EMBODIMENT

Figure 1:
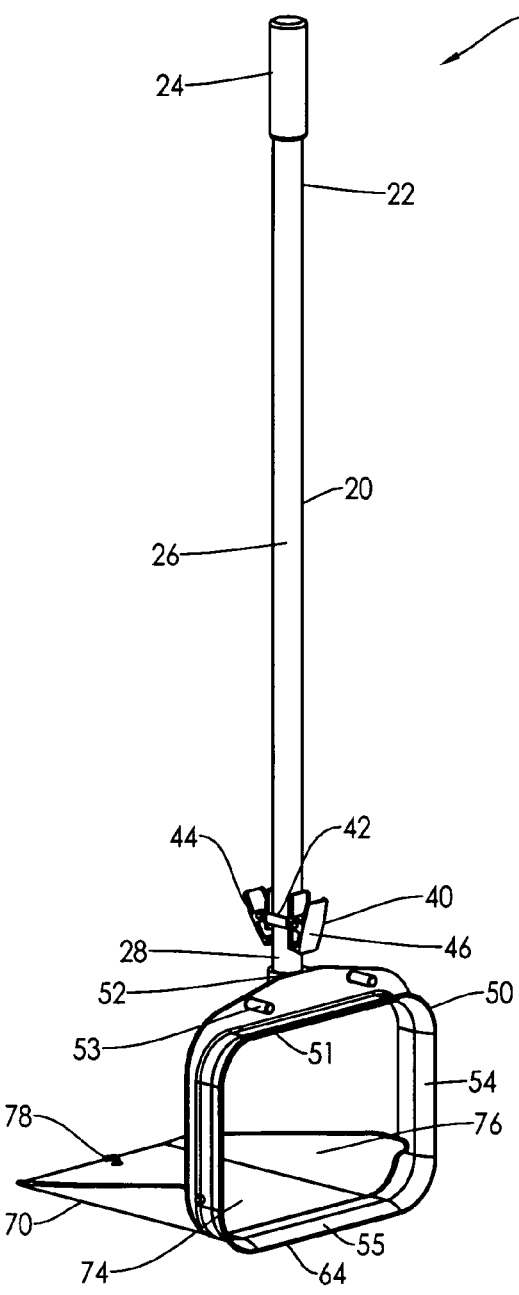
FIG. 1 is a front perspective view of the debris collection and disposal tool with the optional extension tray in a lowered position.
Figure 2:
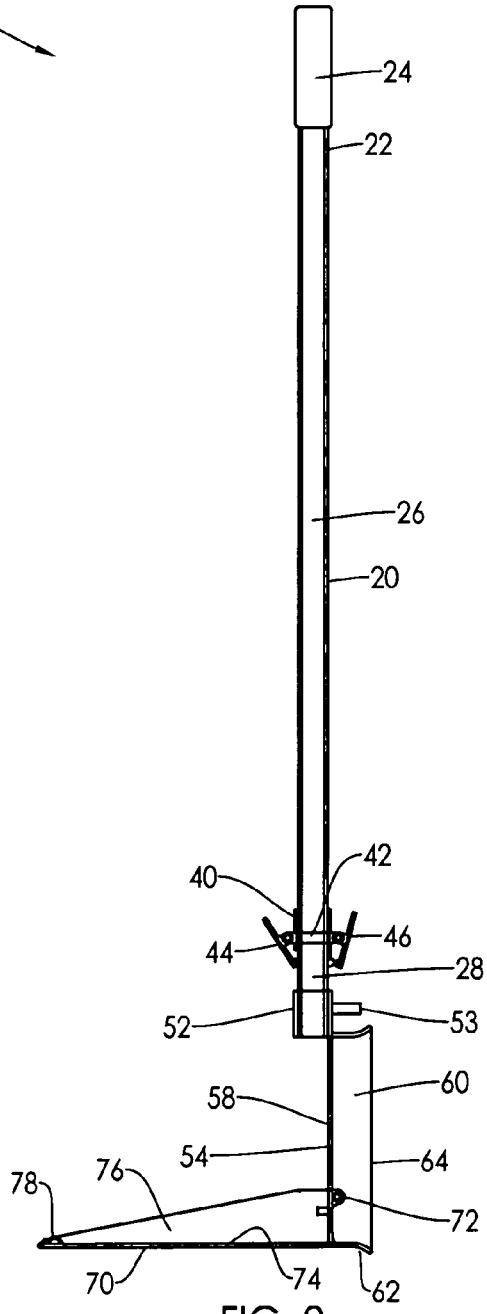
FIG. 2 is a side view of the debris collection and disposal tool.
Figure 3:
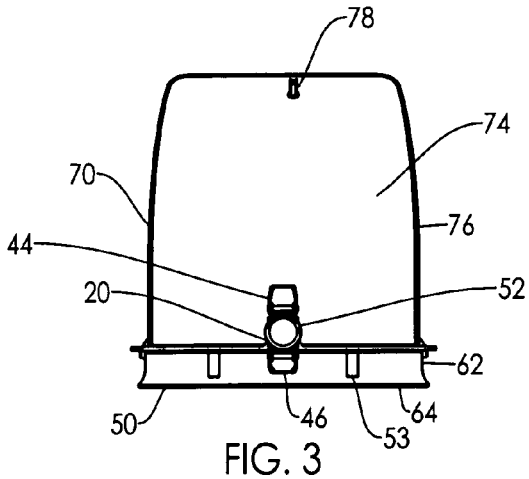
FIG. 3 is a top view of the debris collection and disposal tool.
Figure 4:
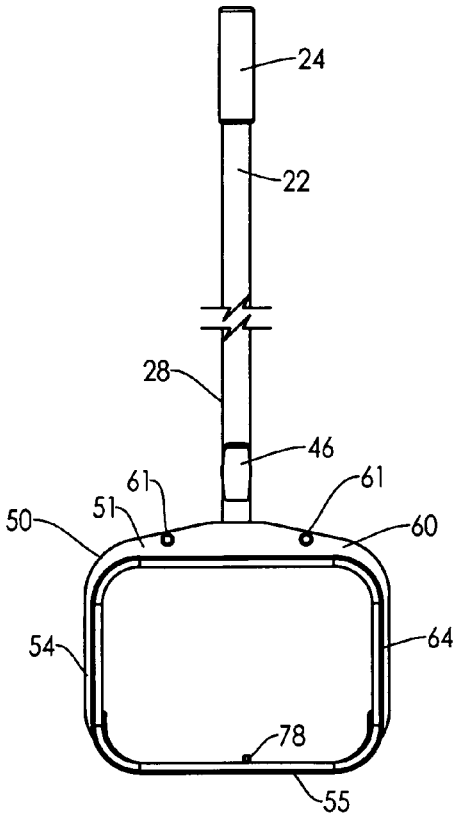
FIG. 4 is a front view of the debris collection and disposal tool.
Figure 5:
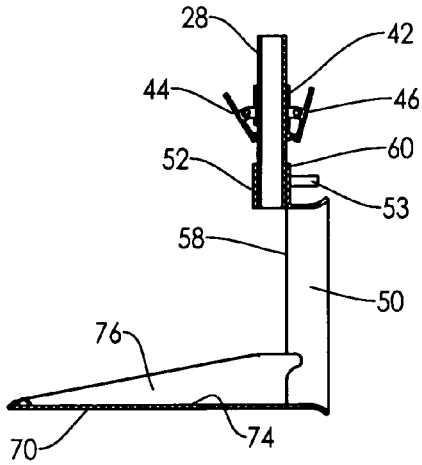
FIG. 5 is a lower side sectional view of the debris collection and disposal tool.
Figure 6:
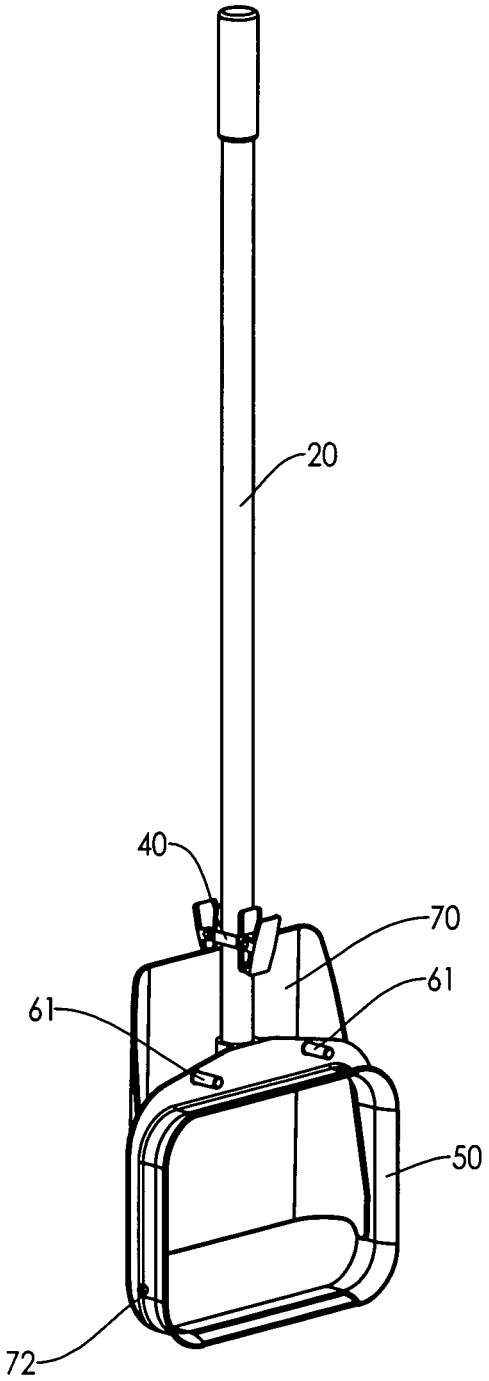
FIG. 6 is the same view of the debris collection and disposal tool as shown in FIG. 1 with the optional bag support tray in a raised position.
Figure 7:
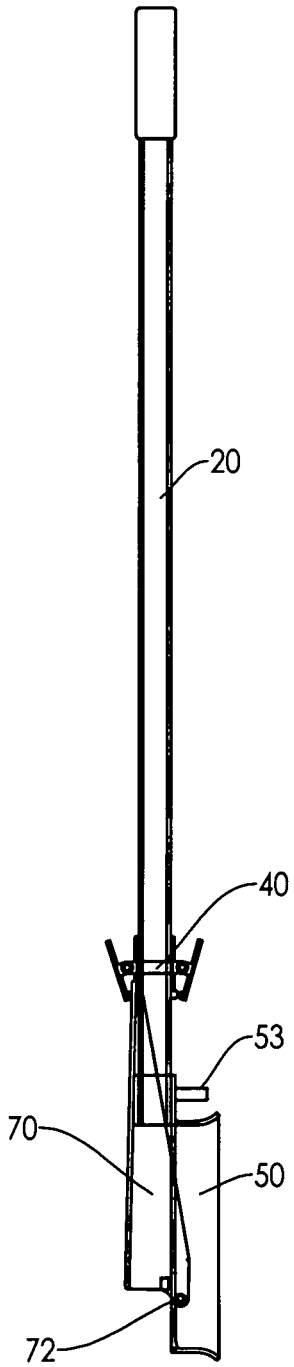
FIG. 7 is a sectional side view of the debris collection and disposal tool as shown in FIG. 2 with the optional bag support tray in a raised position.

A debris collection and disposal tool 10, as shown in an embodiment in FIGS. 1-10, and 11, to receive waste within a supported recycled plastic bag 100, supplies an elongated handle 20 having an upper end 22 defining a grip portion 24, a shaft 26, and a lower end 28, the shaft 26 including a bag clamp and sliding lock assembly 40 including a shaft support collar 42 engaging the shaft 26, a shaft lock 44 and a bag handle clamp 46, the handle 20 further defining the lower end 28 attaching a bag support frame 50. The bag support frame 50 defines an overall hollow ring structure, preferably a rectangular shape as shown in the drawing figures, having an upper section 51 defining an upper handle receiver 52 securing the lower end 28 of the handle 20, side sections 54 and a lower section 55, a front portion 60 defining a bag retaining extension 62 with an outward flared perimeter 64, and a rear portion 58. The rear portion 58 may further extend a retractable bag support tray 70 pivotally attaching to the rear portion 58 by a hinge means 72, providing the bag support tray 70 in a lower position, FIG. 1, and a raised position, FIG. 6. The bag support tray 70 further forms a flat plate 74 with upright side support margins 76 and a distal bag retaining means 78, FIGS. 9-10.

Figure 8:
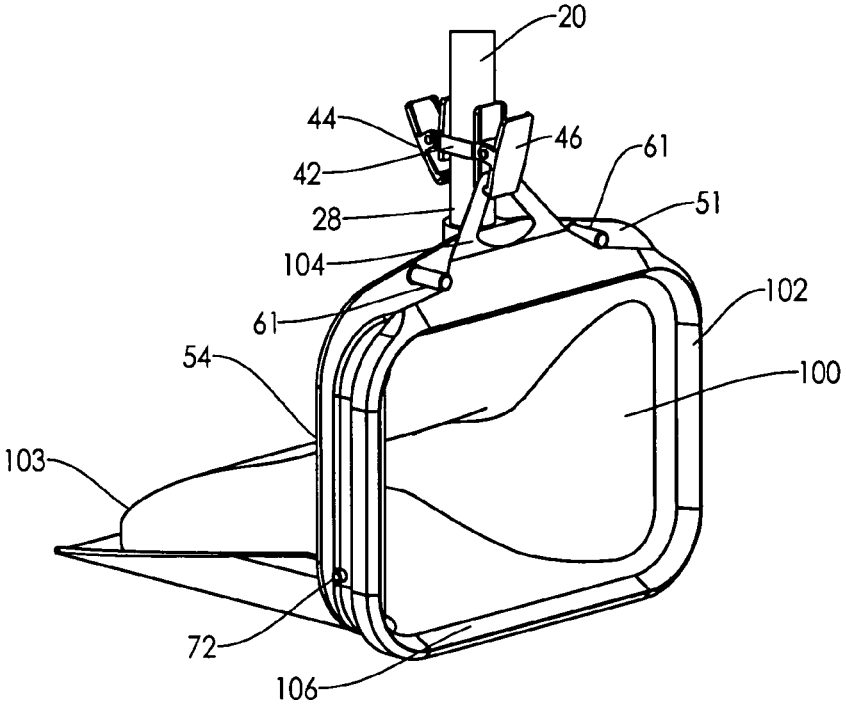
FIG. 8 is a close-up front perspective view of the lower end of the debris collection and disposal tool indicated a recycled plastic bag attached within the lower support frame.
Figure 9:
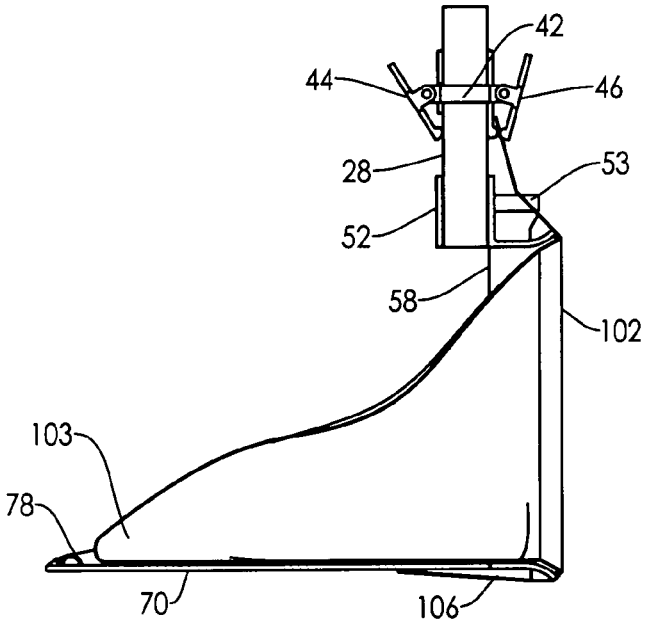
FIG. 9 is a lower side sectional view of the debris collection and disposal tool securing a recycled plastic bag.
Figure 10:
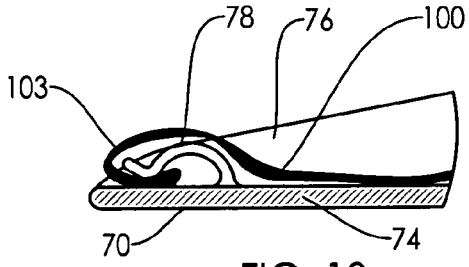
FIG. 10 is a sectional side view of the bag retaining clip upon the distal end of the bag support tray securing the end of the plastic bag.

A recycled plastic bag 100 or other suitable recycled bag, is placed upon the bag support frame 50, in a manner indicated in FIGS. 8-10, with the bag support tray 70 in the lowered position. A bottom 103 of the plastic bag 100 is inserted through the bag support frame 50 from the front portion 60 to the back portion 58, with the bottom 103 of the plastic bag 100 attached within the distal bag retaining means 78, FIGS. 9-10, in the embodiment shown as a resilient clip. An upper opening 102 of the plastic bag 100 would then be attached around the bag retaining extension 62 on the front portion 60 over the outward flared perimeter 64 with a lower handle portion 106 of the plastic bag 100 being placed below the lower section 55 under the bag support frame 50, FIG. 9, while an upper handle portion 104 of the plastic bag 100 is pulled over the upper section 51 of the bag support frame 50 and inserted within the bag handle clamp 46. The user may otherwise position the bag in any manner which secured the bag upon the frame other than as shown in FIG. 9, although the disclosed attachment is preferred.

The upper section 51 of the bag support frame 50 may also extend a forward handle gathering means 53, FIGS. 1-3, 5 and 7, the handle gathering means 53 providing a passage through which the upper handle portion 104 of the plastic bag 100 is threaded prior to being attached within the bag handle clamp 46 to enhance the tension and security of the plastic bag 100 upon the bag support frame 50. Alternatively, the handle gathering means may be presented as a pair of spaced handle gathering pegs, 61, as shown in FIGS. 4, 6, 8 and 11, which narrow the width of the handle and apply lateral pressure to the upper handle portion 104 of the plastic bag 100 providing additional security to the upper handle portion attachment.

Once initially installed, the bag clamp and sliding lock assembly 40 are subsequently slid up the shaft 26 by releasing the shaft lock 44, sliding the shaft support collar 42 upward until the upper opening 102 of the plastic bag 100 is tightly affixed around the bag retaining extension 62 of the bag support frame 50 and secured thereupon, further releasing the shaft lock 44, retaining the bag clamp and sliding lock assembly 40 in place during use of the tool 10, the bag clamp and sliding lock assembly 40 placement selected by the user based upon the limitations of the preferred tension upon the plastic bag 100 and conforming to the size of the plastic bag being used. At this point, the plastic bag 100 is securely retained upon the bag support frame 50 with the bag opening 102 fitted tightly upon the bag retaining extension 62 with the outward flared perimeter 64 preventing the opening 102 of the plastic bag 100 from being removed from the bag support frame 50. The tool 10 is now ready to be used to gather and collect refuse into the plastic bag 100.

The purpose of the bag clamp and sliding lock assembly 40 being moveable along the handle shaft 26 is to provide the tool 10 with the capability to use various sizes of plastic bags meeting the basic component requirements of the disclosed plastic bag 100, the plastic bags 100 being delivered in a variety of different sizes and shapes. This feature eliminates the need to use a proprietary bag, unlike certain prior art devices, making the tool 10 conform to various sized plastic bags 100 instead of searching for a plastic bag 100 conforming to the tool 10.

Figure 12:
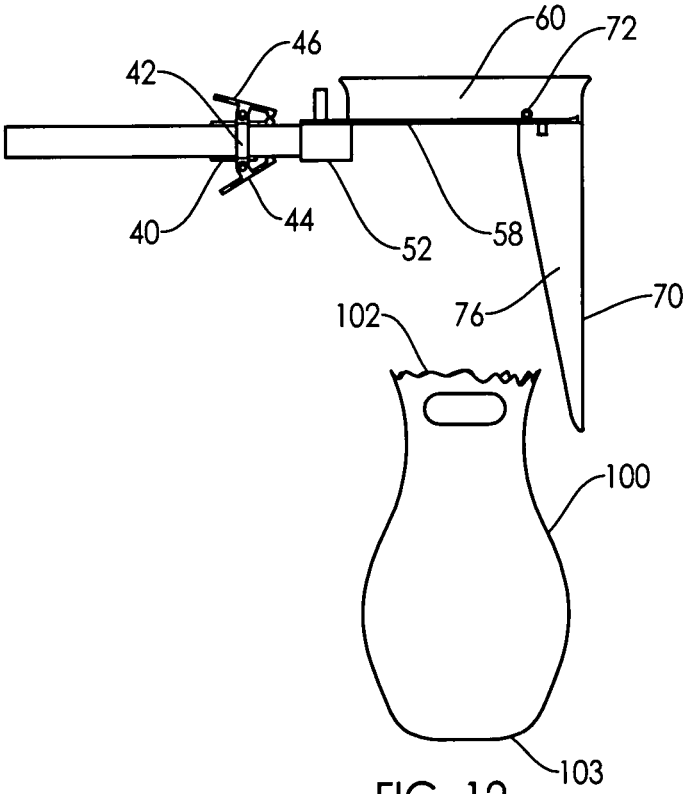
FIG. 12 is a side view of the debris collection and disposal tool releasing the plastic bag from the bag support frame.

To release the plastic bag 10 and its contents once the bag is at a desired fullness, as illustrated in FIG. 12, the user would simply place the filled plastic bag 100 and the waste disposal tool 10 over a trash receptacle, release the bag handle clamp 46 with the simple single-finger depression of the bag handle clamp 46, wherein gravity causes the plastic bag 100 and its contents to drop into the trash receptacle. The upper handle portion 104 of the plastic bag, once released from the bag handle clamp 46, releases tension of the upper opening 102 of the plastic bag 100 upon the bag retaining extension 62 and the upward flared perimeter 64, further releasing the filled plastic bag 100 from the bag support frame 50 for proper disposal wherever chosen by the user.

Figure 11:
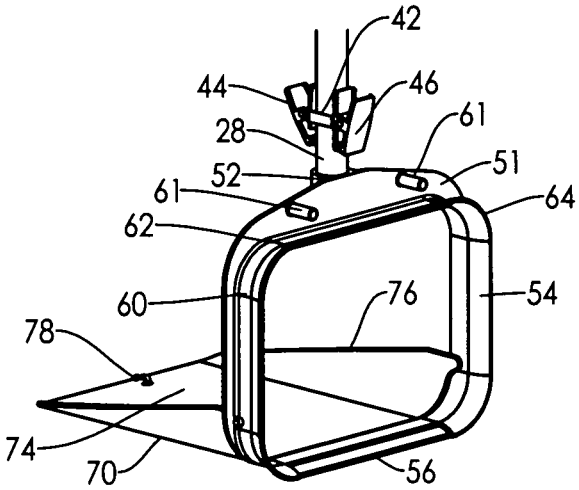
FIG. 11 is a front perspective view of a second embodiment of the debris collection and disposal tool with the extension tray in a lowered position with a lower margin of the bag support frame defining a wire instead of the solid lower margin frame section as shown in FIGS. 1-2, 4-7 and 9.

Alternate embodiments of the debris collection and disposal tool 10 may include the bag support frame 50 having a lower margin defining a shaped wire section 56, shown in FIG. 11, over which the plastic bag 10 would be placed, replacing the solid lower section 55, as shown in FIGS. 1-2, 4-7 and 9. This shaped wire section 56 reduces the profile over that of the lower section 55 of the bag support frame 50 to provide for an easier introduction of small items being swept into the upper opening 102 of the suspended plastic bag 100 and also allow for the bag support frame 50 to be slid under some items so that they can be "flipped" into the plastic bag 100, similar to the action of a spatula, instead of having to be urged into the plastic bag 100 with an accessory tool, as indicated below. This is most useful when attempting to pick up nuts lying on the ground, small clumps of materials or dry animal waste materials.

An accessory tool, not shown, would be recommended for use with the waste disposal tool. This accessory tool could be provided as a broom, a rake, a hoe or a shovel. This shovel is best presented as having an ergo-dynamic handle which can be strapped to the arm of the user with a grip handle on a shovel handle, the shovel used with one arm to urge waste into the waste disposal tool while holding the tool with the other arm.

Although the embodiments of the debris collection and disposal tool have been described and shown above, it will be appreciated by those skilled in the art that numerous modifications may be made therein without departing from the scope of the tool as herein described.

What is claimed is:

1. A debris collection and disposal tool for the collection and receiving of materials, waste or debris within a supported recycled plastic bag, said tool comprising:

an elongated handle having an upper end defining a grip portion, a shaft, and a lower end;

a bag clamp and sliding lock assembly slidingly engaging said lower end of said handle, said assembly further defining a shaft support collar surrounding said shaft, a shaft lock and a bag handle clamp; and a bag support frame defining an overall hollow ring structure having an upper section providing an upper handle receiver securing to said lower end of said handle, side sections and a lower section, a front portion defining a bag retaining extension with an outward flared perimeter, and a rear portion, wherein said plastic bag is placed upon said bag retaining extension, said bag further extending a handle portion which is clamped within said bag handle clamp, after which said shaft support collar is slid upward as said shaft lock is opened until an upper opening of said plastic bag is tightly retained against said bag retaining extension by said outward flared perimeter, with said shaft lock then closed, holding said plastic bag in place upon such bag support frame until such time said plastic bag is filled and readied for disposal by a release of said bag handle clamp.

2. The debris collection and disposal tool as disclosed in claim 1, further comprising:

said rear portion of said bag support frame extending a retractable bag support tray pivotally attaching to said rear portion by a hinge means, providing said bag support tray in a lower position, and a raised position, said bag support tray further forming a flat plate, upright side support margins and a distal bag retaining means, said bag retaining means attaching a bottom of said plastic bag to extend and secure said bottom of said plastic bag open during the process of collection and receiving of materials, waste or debris within said plastic bag.

3. The debris collection and disposal tool as disclosed in claim 1, further comprising:

said upper section said bag support frame extending a forward handle gathering means, said handle gathering means providing passage through which said handle portion of said plastic bag is threaded prior to being attached within said bag handle clamp to enhance tension and security of said plastic bag upon said bag support frame.

4. The debris collection and disposal tool as disclosed in claim 1, further comprising:

said upper section said bag support frame extending a pair of spaced handle gathering pegs which narrow said upper handle portion of said plastic bag handle and apply lateral pressure to said upper handle portion of the plastic bag to provide additional security to said upper handle portion attachment within said bag handle clamp.

5. A debris collection and disposal tool for the collection and receiving of materials, waste or debris within a supported recycled plastic bag, said tool comprising:

an elongated handle having an upper end defining a grip portion, a shaft, and a lower end;

a bag clamp and sliding lock assembly slidingly engaging said lower end of said handle, said assembly further defining a shaft support collar surrounding said shaft, a shaft lock and a bag handle clamp; and a bag support frame defining an overall hollow ring structure having an upper section providing an upper handle receiver securing to said lower end of said handle, side sections and a lower margin defining a shaped wire section, a front portion defining a bag retaining extension with an outward flared perimeter, and a rear portion, wherein said plastic bag is placed upon said bag retaining extension, said bag further extending a handle portion which is clamped within said bag handle clamp, after which said shaft support collar is slid upward as said shaft lock is opened until an upper opening of said plastic bag is tightly retained against said bag retaining extension by said outward flared perimeter, with said shaft lock then closed, holding said plastic bag in place upon such bag support frame until such time said plastic bag is filled and readied for disposal by a release of said bag handle clamp.

6. The debris collection and disposal tool as disclosed in claim 5, further comprising:

said rear portion of said bag support frame extending a retractable bag support tray pivotally attaching to said rear portion by a hinge means, providing said bag support tray in a lower position, and a raised position, said bag support tray further forming a flat plate, upright side support margins and a distal bag retaining means, said bag retaining means attaching a bottom of said plastic bag to extend and secure said bottom of said plastic bag open during the process of collection and receiving of materials, waste or debris within said plastic bag.

7. The debris collection and disposal tool as disclosed in claim 5, further comprising:

said upper section said bag support frame extending a forward handle gathering means, said handle gathering means providing passage through which said handle portion of said plastic bag is threaded prior to being attached within said bag handle clamp to enhance tension and security of said plastic bag upon said bag support frame.

8. The debris collection and disposal tool as disclosed in claim 5, further comprising:

said upper section said bag support frame extending a pair of spaced handle gathering pegs which narrow said upper handle portion of said plastic bag handle and apply lateral pressure to said upper handle portion of the plastic bag to provide additional security to said upper handle portion attachment within said bag handle clamp.

* * * * *